US008622033B2

(12) United States Patent
Ziegs

(10) Patent No.: US 8,622,033 B2
(45) Date of Patent: Jan. 7, 2014

(54) DEVICE FOR CLEANING INTAKE AIR

(75) Inventor: Carsten Ziegs, Hamburg (DE)

(73) Assignee: DOLMAR GmbH, Hamburg (DE)

( * ) Notice: Subject to any disclaimer, the term of this patent is extended or adjusted under 35 U.S.C. 154(b) by 494 days.

(21) Appl. No.: 12/404,668

(22) Filed: Mar. 16, 2009

(65) Prior Publication Data

US 2009/0235880 A1 Sep. 24, 2009

(30) Foreign Application Priority Data

Mar. 18, 2008 (DE) ..... 20 2008 003 781 U

(51) Int. Cl.
*F01P 7/04* (2006.01)

(52) U.S. Cl.
USPC ..... 123/41.65; 123/41.55; 123/41.66; 123/41.7; 123/41.56

(58) Field of Classification Search
USPC ..... 123/41.65, 41.55, 41.56, 41.62, 198 E, 123/41.66, 41.7; 55/DIG. 14
See application file for complete search history.

(56) References Cited

U.S. PATENT DOCUMENTS

| | | | | | |
|---|---|---|---|---|---|
| 1,340,527 | A | * | 5/1920 | Covey | 60/624 |
| 1,400,562 | A | * | 12/1921 | Masury | 123/41.66 |
| 1,474,467 | A | * | 11/1923 | Ferguson | 123/195 R |
| 1,869,575 | A | * | 8/1932 | Murphy et al. | 123/41.33 |
| 3,044,239 | A | * | 7/1962 | Harkness | 56/12.8 |
| 3,640,254 | A | * | 2/1972 | Manfredi | 123/25 B |
| 4,261,302 | A | | 4/1981 | Sheldon | |
| 4,598,671 | A | * | 7/1986 | Gluck et al. | 123/41.31 |
| 4,890,583 | A | * | 1/1990 | Ohno et al. | 123/41.7 |
| 4,907,546 | A | * | 3/1990 | Ishii et al. | 123/41.56 |
| 5,317,997 | A | | 6/1994 | Tomitaku | |
| 5,367,988 | A | | 11/1994 | Collins | |
| 5,937,818 | A | * | 8/1999 | Kawai et al. | 123/198 E |
| 6,039,020 | A | | 3/2000 | Kawamoto et al. | |
| 6,295,953 | B1 | | 10/2001 | Ohsawa et al. | |
| 6,305,332 | B1 | * | 10/2001 | Nishi et al. | 123/41.29 |
| 6,991,664 | B2 | | 1/2006 | Richmann et al. | |
| 7,007,660 | B2 | * | 3/2006 | Taomo et al. | 123/198 E |
| 2004/0206312 | A1 | * | 10/2004 | Liu et al. | 123/41.6 |
| 2005/0173926 | A1 | * | 8/2005 | Aoyama | 290/1 A |

FOREIGN PATENT DOCUMENTS

| | | |
|---|---|---|
| DE | 302439 | 3/1920 |
| DE | 904 006 | 7/1949 |
| DE | 29 39 560 A1 | 4/1981 |
| DE | 36404166 A1 | 8/1986 |
| DE | 42 03 355 C1 | 1/1993 |

(Continued)

OTHER PUBLICATIONS

German Patent and Trademark Office, German Search Report re German Patent Application No. 20 2008 003781.6, Nov. 21, 2008.

*Primary Examiner* — Noah Kamen
*Assistant Examiner* — Long T Tran
(74) *Attorney, Agent, or Firm* — Kelly & Kelley, LLP

(57) ABSTRACT

A device is provided for a piece of equipment with an internal combustion engine having a crank case and a combustion space, wherein an air cooling stream is present for cooling the internal combustion engine. The device, on the one hand, is effective for cleaning of the intake air, and on the other hand, a thermal separation between tank and crank case is achieved in a simple manner. The device includes at least one recess, which is constructed open or closed, and is arranged in the crank case, and is separated from an interior of the crank case and forms air cushions.

8 Claims, 3 Drawing Sheets

(56) References Cited

FOREIGN PATENT DOCUMENTS

Figure 1:
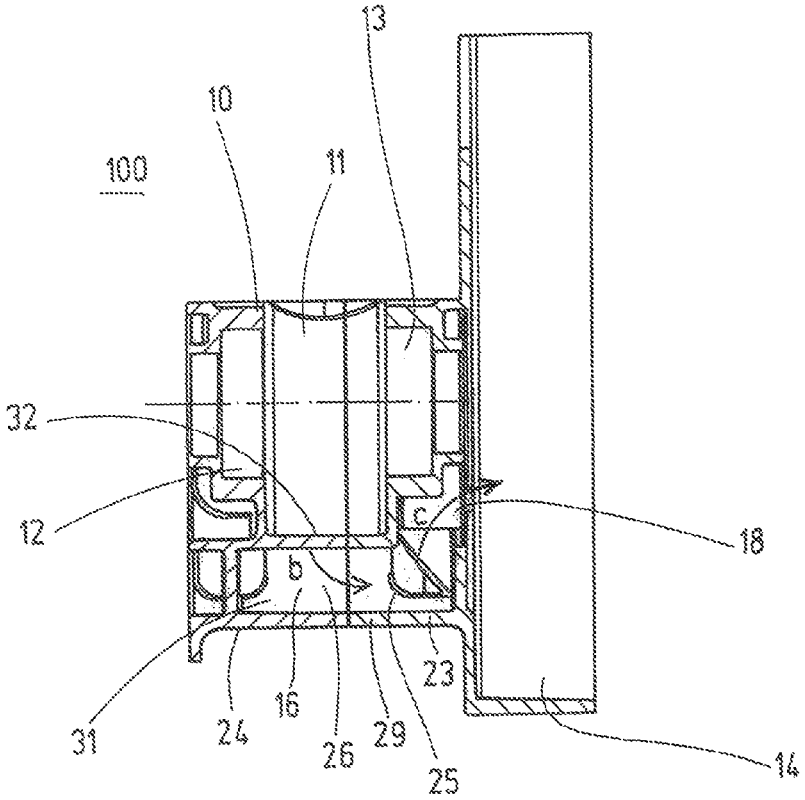

| | | | |
|---|---|---|---|
| DE | 197 00 124 | A1 | 7/1997 |
| DE | 197 52 798 | A1 | 6/1999 |
| DE | 198 33 126 | A1 | 1/2000 |
| DE | 102 35 761 | A1 | 2/2004 |
| DE | 102 45 419 | A1 | 4/2004 |
| DE | 102 97 268 | T5 | 11/2004 |
| DE | 102004058136 | A1 | 6/2006 |
| EP | 1 135 585 | B1 | 9/2001 |
| JP | 08158867 | A | 6/1996 |
| JP | 2000263509 | A | 9/2000 |
| JP | 2001059455 | A | 3/2001 |
| JP | 2007113443 | A | 5/2007 |
| WO | EP 0 294 821 | A2 | 12/1988 |
| WO | WO 97/44582 | A1 | 11/1997 |
| WO | WO 2008057015 | A1 | 5/2008 |

* cited by examiner

DEVICE FOR CLEANING INTAKE AIR

TECHNICAL FIELD

The invention relates to a device for a piece of equipment with an internal combustion engine comprising a crank case and a combustion space, wherein an air cooling stream is present for cooling the internal combustion engine.

In the case of pieces of equipment, such as chain saws, cutoff saws, etc. there is the problem that they are associated with severe soiling effects. Dust produced during the cutting procedure or other dirt particles can be deposited on cooling ribs of an internal combustion engine and reduce their cooling effect, but even an air filter of the internal combustion engine can quickly become blocked with dust.

PRIOR ART

So-called cyclone separators or cyclones, which separate dirt particles from the intake air by means of the centrifugal effect, can be used so that the internal combustion engine can permanently be supplied with clean combustion air.

A further problem is that, on account of a desired compact design, a tank must be arranged relatively close to the internal combustion engine. The tank can however be exposed to undesirable heat radiation in this case.

A hand-operated piece of equipment with an internal combustion engine and a cyclone separator is known from DE 10 2004 058 136 A1. Here, extracted air is carried via an extraction duct and an extraction hose which conveys the air through the fuel tank to the impeller. The extraction hose is arranged between the housing of the tank and the crank case of the internal combustion engine. The extraction hose is at the same time used as an installation channel, through which the cylinder barrel bolts can be tightened or loosened.

Furthermore, a piece of equipment with an internal combustion engine, in the case of which the internal combustion engine should be useable even at very low ambient temperatures, is shown and described in DE 102 97 268 T5. To this end, the air conducting takes place through a channel built into the wall of the crank case in such a manner that the heat generated by the combustion in the engine is used in order to preheat air in this channel before this air reaches the carburettor. In the operating state, without preheating the inlet air, the pure air is conducted via a second channel outside of the crank case.

A piece of equipment with a channel formed at the crank case is furthermore known from EP 1 135 585 B1. This channel is connected at one end to the crank case interior and at the other end to a gas exchange channel for the cylinder.

DESCRIPTION OF THE INVENTION

Object, Solution, Advantages

The object of the invention is to create a device for cleaning intake air of the type mentioned, with which on the one hand effective cleaning of the intake air is possible, but on the other hand a thermal separation between tank and crank case is achieved in a simple manner.

This object is achieved by a device with the features of claim 1. Advantageous developments of the invention are characterized in the dependent claims.

The invention is based on the idea of creating a recess separated from the crank space in the crank case, which recess forms an air cushion. As a result, the tank is exposed to less heat. At the same time it is possible, in the case of a piece of equipment with cyclone separation for the combustion air, to create an air channel which conveys the extracted air out of the cyclone to the extracting impeller/fan impeller.

This channel can be constructed easily in practice by two recesses in the two crank case halves in the tool-closing direction.

Additionally, the extracted air can be conveyed centrally behind the fan impeller and there fed to the fan impeller over a large area.

The extracted air can additionally be used as cooling air for the crank case at the same time and in this manner reduces heat radiation in the direction of the fuel tank.

In a preferred embodiment of the device according to the invention it is provided that the recess is constructed as a channel with an air inlet opening and with an air exhaust opening for passing through an air volume stream. This channel is used as a single channel independently from the external temperature. As a result, the crank case is constantly cooled during operation so that the tank is always subjected to a lower heat exposure and can be arranged relatively close to the crank case. As a result, a very compact design of a hand-operated piece of equipment is possible.

It is particularly advantageous if at least one cyclone, which is provided for cleaning the intake air, is used, wherein the air volume stream through the channel is the extracted air stream of the cyclone.

If the intake air from the cyclone is generated by a ventilator so that the extracted air from the recess is sucked out, it is conceivable that a separate fan is arranged. The fan is expediently used on the impeller for this purpose however.

It is beneficial that the extracted air stream of the cyclone is generated by a ventilator, particularly a radial ventilator provided with at least one blade ring. The required negative pressure through the channel of the crank case can be generated without an additional ventilator. The single radial ventilator is suitable on the one hand for cooling the engine and on the other hand for operating the cyclone or for cleaning air. This can take place in a simple manner if the extracted air from the cyclone is sucked out of the recess via the radial ventilator.

By means of the fact that the fan impeller is realized as an impeller which has a magnet and is for activating an ignition coil, or by means of the fact that a fan is used on the impeller, on the one hand contact breakers can be dispensed with, but on the other hand the fan impeller can also be arranged relatively close to the engine housing. As the channel in the crank case is then arranged very close to the impeller, a higher negative pressure can be generated in the region of the impeller, so that the ignition procedures of the engine and its cooling can be achieved effectively.

In accordance with a further advantageous development of the invention, the cyclone extracted air is conveyed through a channel formed by the recess behind the fan impeller or impeller. The air heated by the engine can then be blown out of the housing of the piece of equipment on a side close to the tool, so that it is directed away from a person operating the piece of equipment.

From the point of view of flow technology, it is furthermore very beneficial if a fan housing is present which adjoins the crank case and has a bottom wall which is surrounded by an outer wall, wherein the bottom wall is in flow connection with the open air channel, which is formed by the recess, through an air exhaust opening of the recess and the outer wall has an open region which is provided for air exhaust. This configuration can also be used in order to achieve the flow in the fan housing for further cleaning of the blown out air. Further dirt chambers can, in a simple manner, be present at the fan housing, so that a further centrifugal effect can be used in the fan housing for dirt separation.

A very installation-friendly solution which is very simple to achieve from the point of view of production technology is created in that the crank case is divided into two crank case halves which, in each case form the recess by means of at least one hollow. One recess is then present at each of the halves, which together form a common recess and a flow channel. Each half has an uncomplicated shape, which simplifies the production. Bearing elements for the engine shaft can also be mounted in a simple manner because the crank space for the installation is easily accessible.

Basically, each case half of the crank case can have an opening for the recess shaped flow channel. A further advantage results however, if both an air inlet opening for the air channel of the crank case and an air exhaust opening of the air channel of the crank case or of the recess of the crank case are present on one of the crank case halves. The air stream is conveyed into the recess and can be conveyed into the other case half by means of suitable shaping of the recess, so that this half is also covered by the volume stream. Thus, the bearing element which is also arranged in this half is exposed to less heat by means of the cooling effect of the air stream. Subsequently, the air stream is again conveyed into the first side of the crank case, so that it can be blown out directly through an opening on the case bottom of the fan housing. This elongated or serpentine air path improves the cooling effect in the crank case so that the tank is exposed to very low heat radiation and it can readily be arranged close to the crank case.

Figure 2:
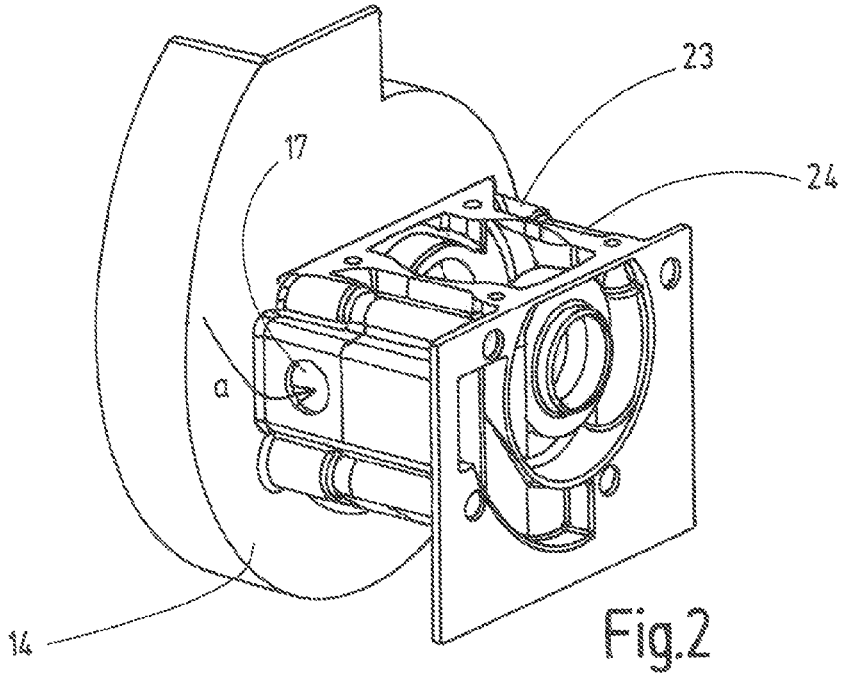
Figure 3:
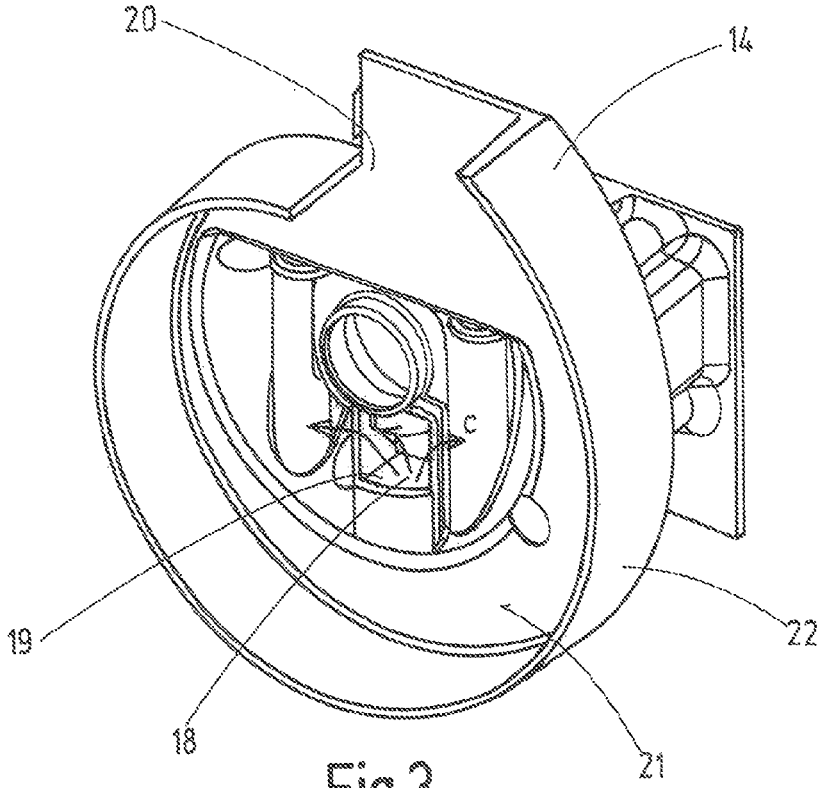
Figure 4:
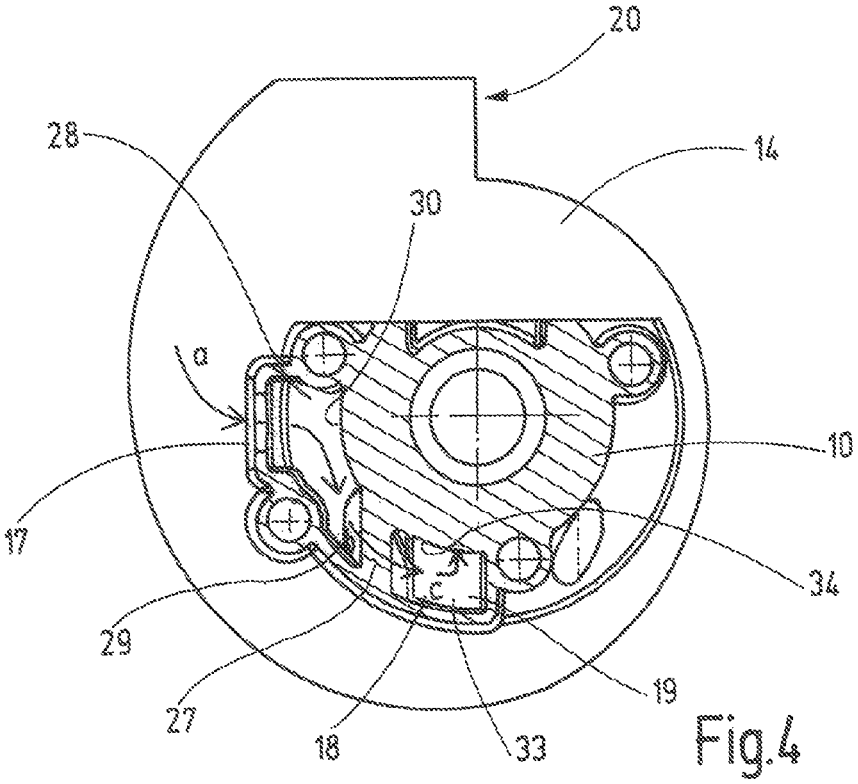

An exemplary embodiment is explained in more detail on the basis of the drawings, advantageous developments of the invention and advantages of the same being described. In the figures:

FIG. 1 shows a cross sectional view through a crank case in a schematic view, an air exhaust being shown behind an impeller, FIG. 2 shows a perspective view of the crank case in a schematic view, an air inlet being illustrated in the crank space, FIG. 3 shows a perspective view from a magnet side of the crank case in a schematic view, an air exhaust out of the crank space being illustrated, and FIG. 4 shows a cross sectional view of the crank case in a schematic view, an air channel being shown in the crank case.

Figure 5:
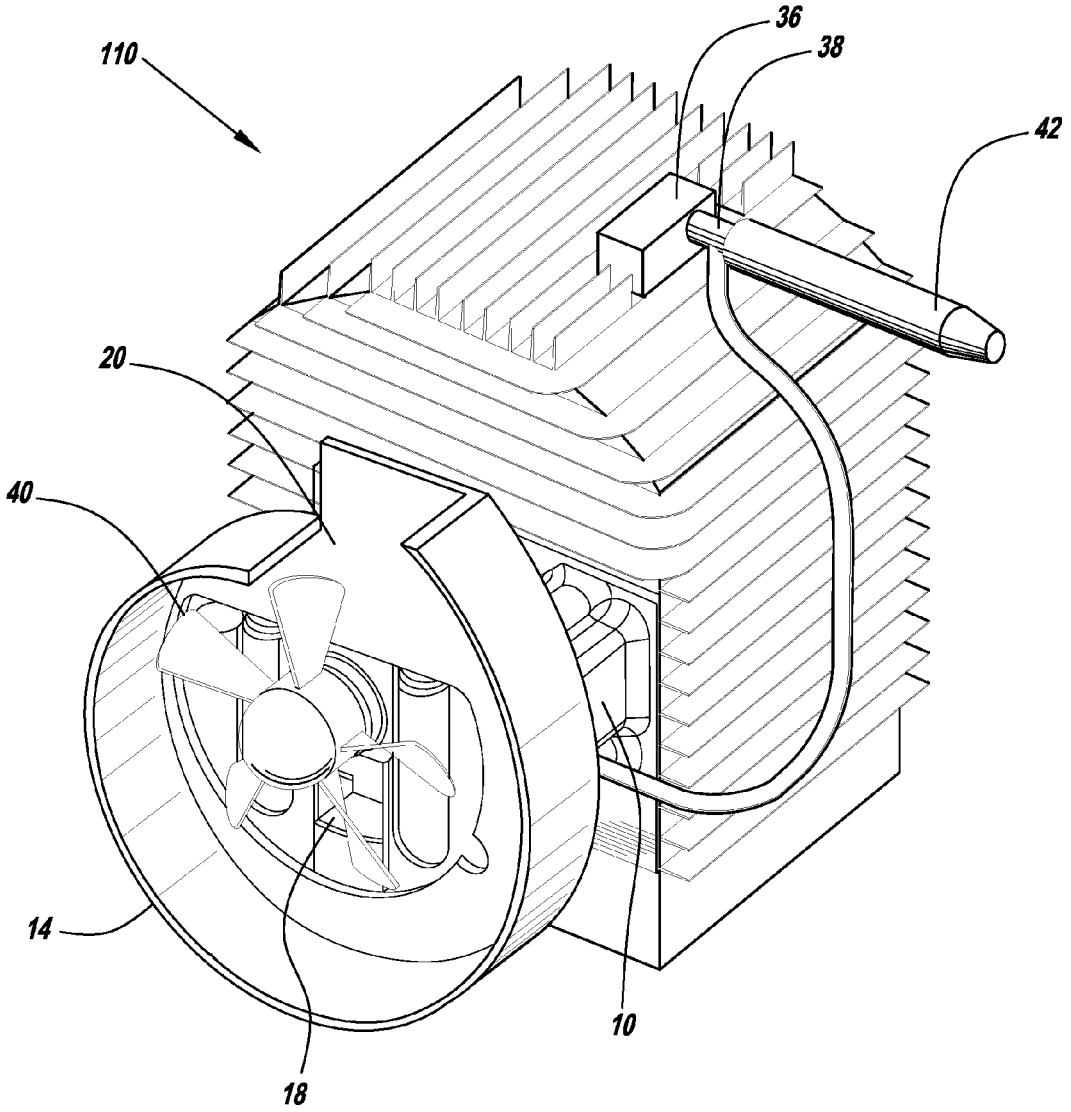

FIG. 5 shows a perspective view of the crank case in a partially assembled relationship with an internal combustion engine.

BEST WAY OF REALIZING THE INVENTION

FIG. 1 shows a device 100 for cleaning intake air for a piece of equipment or a part thereof, particularly a chain saw. What can be seen is a section through a crank case 10 of an internal combustion engine. FIG. 5 illustrates the crank case 10 in a partially assembled relationship with an internal combustion engine 110 as described herein.

The chain saw essentially consists of a drive unit and a tool. The drive unit essentially consists of the internal combustion engine which is arranged in a device housing and is supplied with combustion air and cooling air.

The internal combustion engine comprises a crankshaft which drives a fan impeller. The crankshaft is located in the interior 11 of the crank case 10 shown in FIG. 1, wherein two bearing points 12, 13 for bearing elements, for example roller bearings, are present in order to mount the crankshaft rotatably. The crankshaft is connected to a connecting rod, which is connected to the cylinder of a two-stroke engine with a combustion space. The air cooled two-stroke engine has cooling ribs.

The internal combustion engine is supplied with a fuel-air mixture by means of the carburettor 36. The air for the carburettor is cleaned by means of an air intake or filter 38 in combination with a cyclone 42, wherein the combustion air flows through the filter 38 before entering into the cylinder of the internal combustion engine.

A chain sprocket is furthermore arranged on the crankshaft in order to drive the chain of the chain saw. Additionally, aside from the engine, a tank for petrol or another fuel is arranged in a chain saw housing. Two handles are fixed to the housing or to a supporting element in a manner known per se. If the device 100 is used in another hand-operated piece of equipment, e.g. an angle grinder, then a corresponding adapted configuration is to be taken into account. For example, the drive shaft can be connected directly to the tool, e.g. cutoff wheel, wherein e.g. handles are shaped according to the tool.

The fan impeller 40 is located in a fan housing 14 which directly adjoins the crank case 10, as is illustrated in FIGS. 1 and 5.

In the chain saw housing, at least one dirt space can further be provided for a cleaning procedure based on a centrifugal effect.

In order that the tank located in the chain saw housing is thermally insulated with respect to the internal combustion engine, the internal combustion engine also being arranged in the same housing, at least one recess 16, which is arranged in the crank case 10 and is thermally separated from the interior 11 of the crank case 10 and forms an air cushion, is present according to the invention. The air cushion provides a thermal separation between the tank and the interior 11 of the crank case 10. The recess 16 can be constructed basically open or closed. Preferably, the recess 16 has two openings 17, 18, however, wherein the first opening which is realized as an air inlet opening is an air inlet opening 17 and the second opening is an air exhaust opening 18. As a result, the recess can also be used as an air channel 19 in order to replace a hose or the like.

By means of the recess 16 in the crank case 10 or the air channel 19, it is possible in a simple manner to conduct air, which comes from e.g. at least one cyclone 42, behind the fan impeller 40 so that it is available there for cooling. The air channel 19 enables the passing through of an air volume stream. It is also possible to cool the crank case 10 by means of this volume stream, so that a tank arranged in the vicinity of the crank case is exposed to lower heat radiation. This allows a compact design.

The cyclone intake air is conveyed through the air channel 19 formed by the recess 16 behind the fan impeller 40. This means that the extracted air is conveyed directly out of the cyclone 42 via the air channel 19 onto the blades of the fan impeller 40.

Admittedly, the recess 16 is first and foremost used to create an air cushion, so that the tank can be positioned relatively close to the internal combustion engine and thus the chain saw or another hand-operated piece of equipment can obtain very compact dimensions. In a sense, the air channel is also suitable in order to prewarm the combustion air supplied to the carburettor, so that operating the chain saw at very low temperatures is also improved. The crank case 10 namely forms a compact unit with the cylinder housing, so that both housings are fundamentally thermally coupled, heat transfer taking place from the cylinder housing to the crank case 10.

Connected at the first opening 17 of the crank case 10 is the already mentioned combustion air/prefilter, which e.g. can also comprise a plurality of cyclones. A cyclone can therefore also be a cyclone battery. The cyclones can be arranged tube-like and parallel to one another in a region away from the tool. The dirt particles separated by the cyclones are collected in a common dirt space. A common connecting channel extends out of the latter for example directly to the air inlet opening 17 of the recess 16 and therefore to the channel 19 in the crank case.

A negative pressure, which is brought about by the fan impeller, is present at the opening 17. The cyclone, which is preferably located at the end facing away from the cutting tool, brings about a cyclone-like air vortex. By means of the latter, dirt particles are moved into the vicinity of the walls of the cyclone on account of the centrifugal effect and collected in a dirt chamber.

The cyclone separator is a centrifugal separator which separates an air stream into a bypass stream and a core stream. On account of the centrifugal force, the bypass flow has a higher dirt particle density. Dip tubes are arranged in every tube-like cyclone so that only the clean core stream is removed through the dip tubes. By contrast, the bypass stream is fed to a dirt collection space in a manner known per se. The functioning of a cyclone is sufficiently well known and does not therefore need to be explained in any more detail.

The fan impeller axially sucks air out of the opening 18 shown in FIG. 3 and conveys it by means of the fan impeller movement out of a radially open region 20 out of the fan housing 14 into the interior of the chain saw housing. The housing 14 of the fan impeller consists, as illustrated in FIG. 3, of a housing bottom 21, which extends radially to the crankshaft between the fan impeller and the internal combustion engine, particularly its crank case 10. Furthermore, the fan housing 14 has an outer wall 22. This conveys the air carried from the fan impeller and is recessed at an arc section facing the internal combustion engine, as a result of which a cooling air exhaust is constructed. The outer wall 22 is constructed as an open spiral baffle, cooling air being blown through the cooling air exhaust onto the cooling ribs formed on the cylinder.

The housing bottom 22 is recessed in the region of the air exhaust opening 18, so that the volume stream of the air channel 19 can be blown unhindered via the blades out of the open region 20.

As FIG. 3 and FIG. 4 show, the air exhaust opening 18 is located in a region which constitutes approximately one third of the distance from the shaft to the outer wall 22, so that an optimal negative pressure is achieved by the blades.

The fan impeller can have a blade ring on a side which faces the housing bottom 21. Alternatively, the fan impeller can carry blade rings on both axial end faces. Basically, the fan impeller can also be realized for centrifuging dirt particles.

The cyclone extracted air is conveyed through the channel 19 at the crank case 10 directly behind the fan impeller by means of the configuration according to the invention.

The fan impeller has a magnet which turns with the fan movement, so that for every rotational movement into an ignition coil, an ignition voltage is induced. The fan impeller arranged in the fan housing is realized as a so-called impeller. The fan impeller can also be connected to a separate impeller.

As shown in FIGS. 1 and 2, the crank case consists of two crank case halves 23, 24 which in each case form the recess 16 by means of a hollow 25, 26.

The first case half 23, which advantageously comprises both openings 17, 18, is in particular integrally connected to the fan housing 14. The openings 17, 18 can also be constructed in different case halves 23, 24 or case parts.

As FIGS. 1 and 4 show, the volume stream is partly also conveyed via the second case half 24, namely via a web 27 as well as further webs, so that the volume stream flows through both case halves 23, 24.

As FIG. 1 and FIG. 4 furthermore illustrate, air, which is extracted from the cyclone, flows into a first chamber 28 of the recess 16. This is arranged in the first case half 23 of the crank case. Outer walls 29 delimit the volume stream and create the recess interior. A first inner wall 30 separates the interior of the recess 16 from the interior 11 of the crank case 10. The volume stream is conducted via the web 27 of a second chamber 31 which is arranged in the second crank case half 24. A second wall 32 separates the crank space 15 from the interior of the recess 16. Subsequently, the volume stream is again fed back into the first crank case half 23, so that it is conveyed into a third chamber 33. In the process, a third wall 34 separates the air channel from the interior 11 of the crank case 10. The air of the cyclone then flows out of the third chamber 33 behind the impeller and through the exhaust opening 18, as FIG. 3 shows.

Instead of this solution with a plurality of chambers 28, 31, 33, as is shown in the Figures, other chambers can also form the recess 16 or the air cushion. The recess 16 is therefore preferably formed by a plurality of chambers. These chambers are particularly arranged distributed over both case halves 23, 24. Preferably, the air flows in a serpentine manner or in an arc through the chambers or the recess 16.

The air flow in the air channel 19 progresses, as the arrows in the FIGS. 1 to 4 show, partly radially to the engine shaft or drive shaft, which drives the fan impeller and the tool. The arrows a in FIG. 2 and FIG. 4 show a radial flow.

The air flow can change its direction from radial to axial and vice versa, as the arrows b and c in FIG. 1 and FIG. 4 show. The volume flow also partly progresses only axially, e.g. out of the opening 18 into the ventilator or fan housing 14, as FIG. 3 shows.

The piece of equipment can be not only a chain saw, but rather also another hand-operated tool, such as a hedge trimmer, a strimmer, a circular saw or jigsaws, an angle grinder and the like.

Not shown in the figures are the device housing, the tank, the fan or impeller, the complete engine or the cyclone, for example. These and other components which are not shown can readily be realized and arranged in accordance with the example of JP 2001 05 94455 A, JP 2007 113443 A, U.S. Pat. No. 5,317,997, U.S. Pat. No. 6,991,664, U.S. Pat. No. 4,261,302, U.S. Pat. No. 5,367,988, U.S. Pat. No. 3,884,067, WO97/44582, U.S. Pat. No. 6,295,953 B1, DE 102 35 761 A1, DE 198 33 126 A1, DE 197 00 124 A1, DE 102 45 419 A1, DE 102 35 761 A1, DE 36 04 166 A1, DE 29 39 560 A1 JP 2000 263509 A, JP 08158867 A, DE 197 52 798 A1, DE 42 03 355 C1, DE 10 2004 058 136 A1, DE 102 97 268 T5 and EP 1 135 585 B1.

The invention claimed is:

1. A crank case for an internal combustion engine, wherein an air cooling stream is present for cooling the internal combustion engine, characterized by at least one recess in the crank case formed by at least one hollow in at least one of two separate halves of the crank case, the at least one recess separated from an interior of the crank case and forming an air pocket or chamber between the interior of the crank case and at least one side of the crank case, wherein the at least one recess is constructed as an air channel with an air inlet opening and with an air exhaust opening for passing through an air volume stream.

2. The crank case of claim 1, wherein the air volume stream flowing through the recess is provided as cooling air for the crank case at the same time.

3. The crank case of claim 1, wherein both the air inlet opening and the air exhaust opening are present on one of the crank case halves.

4. The crank case of claim 1, wherein the recess is configured so as to create a serpentine flow path, so that the air volume stream contacts both halves of the crank case and/or is conveyed over a wall of the interior of the crank case.

5. A crank case for an internal combustion engine, wherein an air cooling stream is present for cooling the internal combustion engine, characterized by at least one recess in the crank case formed by at least one hollow in at least one of two separate halves of the crank case, the at least one recess separated from an interior of the crank case and forming an air pocket or chamber between the interior of the crank case and at least one side of the crank case, wherein the at least one recess is constructed as an air channel with an air inlet opening and with an air exhaust opening for passing through an air volume stream; and at least one cyclone, within the crank case for cleaning an air intake for a combustion space, wherein the air volume stream comprises an air stream extracted from the cyclone which is pushed or sucked through the recess by positive or negative pressure.

6. The crank case of claim 5, further comprising a one- or multi-piece fan housing which adjoins the crank case and has a bottom wall surrounded by an outer wall, wherein the bottom wall is in flow connection with the air channel formed by the recess, through the air exhaust opening of the recess.

7. The crank case of claim 6, wherein the outer wall has an open region which is provided for air exhaust.

8. The crank case of claim 6, wherein the air exhaust is provided at the outer wall for the cooling air supply of the internal combustion engine at a region supplied with cooling ribs and/or for the air supply of a carburettor.

* * * * *